US008820583B2

(12) United States Patent
Kim

(10) Patent No.: US 8,820,583 B2
(45) Date of Patent: Sep. 2, 2014

(54) DISPENSER FOR REFRIGERATOR

(75) Inventor: Seong Taik Kim, Changwon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 13/352,933

(22) Filed: Jan. 18, 2012

(65) Prior Publication Data

US 2012/0181304 A1 Jul. 19, 2012

(30) Foreign Application Priority Data

Jan. 19, 2011 (KR) ..... 10-2011-0005620

(51) Int. Cl.

| | |
|---|---|
| ***B67D 7/06*** | (2010.01) |
| ***B67D 3/00*** | (2006.01) |
| ***B65D 43/14*** | (2006.01) |
| ***B65D 51/04*** | (2006.01) |
| ***F25D 23/12*** | (2006.01) |

(52) U.S. Cl.

CPC . *B67D 7/06* (2013.01); *F25D 23/12* (2013.01)
USPC ..... 222/182; 222/505; 220/811; 62/338

(58) Field of Classification Search

CPC ..... B67D 3/0009; B67D 3/0025; B67D 7/06; F25D 23/12; F25D 23/126; F25D 23/028; F25C 5/005; F25C 2400/10
USPC ..... 222/108, 111, 182, 505, 508, 533–534; 220/213, 241, 242, 252, 323, 558, 220/811–816, 825, 829, 830; 312/405, 312/405.1, 321.5, 292, 139.1, 139.2, 270.2, 312/270.3, 291, 321, 322, 323, 334.7, 350; 62/338, 389, 390, 391, 392–400
See application file for complete search history.

(56) References Cited

U.S. PATENT DOCUMENTS

| | | | | | |
|---|---|---|---|---|---|
| 2,724,629 | A * | 11/1955 | Atchison | 312/274 |
| 3,140,136 | A * | 7/1964 | Clark | 312/323 |
| 3,747,363 | A * | 7/1973 | Grimm | 62/377 |
| 4,209,999 | A * | 7/1980 | Falk et al. | 62/344 |
| 4,790,146 | A * | 12/1988 | Mun et al. | 62/441 |
| 5,474,376 | A * | 12/1995 | Saunders | 312/322 |
| 6,425,425 | B2 * | 7/2002 | Bianchi et al. | 141/362 |
| 6,679,082 | B1 * | 1/2004 | Tunzi | 62/344 |
| 6,688,134 | B2 * | 2/2004 | Barton et al. | 62/390 |
| 6,715,302 | B2 * | 4/2004 | Ferragut, II | 62/129 |
| 7,137,272 | B2 * | 11/2006 | Park et al. | 62/389 |
| 7,316,121 | B2 * | 1/2008 | Lee et al. | 62/344 |
| 7,340,915 | B2 * | 3/2008 | Kwon | 62/398 |
| 7,775,613 | B2 * | 8/2010 | Williams | 312/321.5 |
| 7,958,742 | B2 * | 6/2011 | Park et al. | 62/389 |
| 7,997,452 | B2 * | 8/2011 | Kim et al. | 222/182 |
| 8,196,618 | B2 * | 6/2012 | Kim et al. | 141/82 |
| 8,263,231 | B2 * | 9/2012 | Mesa | 428/524 |
| 2010/0319388 | A1 * | 12/2010 | Yang et al. | 62/389 |

* cited by examiner

*Primary Examiner* — Paul R Durand
*Assistant Examiner* — Matthew Lembo
(74) *Attorney, Agent, or Firm* — Birch, Stewart, Kolasch & Birch, LLP

(57) ABSTRACT

A dispenser for a refrigerator includes a cavity provided at one side of a door and a discharge opening provided at an upper surface of the cavity. A cover is movable to inside of the cavity, and configured to open and close the cavity. An inclination surface is provided on an inner surface of the cavity. A switch on the inclination controls dispensing of water or ice from the discharge opening. Under this configuration, water or ice is dispensed from the discharge opening if the switch is actuated as the cover moves to the inside of the cavity to contact the inclination surface. The cover is coplanar with an outer surface of the door to close the cavity.

13 Claims, 7 Drawing Sheets

DISPENSER FOR REFRIGERATOR

CROSS-REFERENCE TO RELATED APPLICATION

This application claims the benefit under 35 U.S.C. §119 to Korean Patent Application No. 10-2011-0005620, filed on Jan. 19, 2011, which is hereby incorporated by reference for all purposes as if fully set forth herein.

BACKGROUND OF THE INVENTION

1. Field of the Invention

The present disclosure relates to a dispenser for a refrigerator enhancing the appearance of a door which determines the appearance of a refrigerator, reducing a thickness of the door for efficient spatial utilizations of the refrigerator, having an enhanced sanitary characteristic, and enhancing a user's convenience.

2. Background of the Invention

Generally, a refrigerator indicates an apparatus for storing food items in a frozen or cooled state, by using cool air generated as a refrigerant undergoes phase changes. Recently, the refrigerator is provided with various functions such as a home bar and a dispenser. This refrigerator serves as an apparatus for enhancing a user's convenience, not as a mere storage apparatus. According to the recent trend for a large size, a two-door refrigerator having side-by-side doors is being utilized.

FIG. 1 is a perspective view schematically showing the appearance of a two-door refrigerator in accordance with the conventional art. Referring to FIG. 1, the conventional refrigerator comprises a body 1 having therein a plurality of drawers and trays for storing food items in a frozen or cooled state.

On a front surface of the body 1, doors 2 are outwardly rotatable so that right and left spaces of the refrigerator can be selectively closed. A home bar 3 and a dispenser 4 for a user's convenience are provided on a front surface of the doors.

The home bar 3 is provided at one side of the door, through which a user can dispense beverages or liquors without opening the door. This reduces the loss of cool air occurring when the door is open, resulting in reducing power consumption.

The dispenser 4 is provided at one side of the door, and a user can dispense water or ice without opening the door. The dispenser 4 includes a cavity 7 concaved toward the inside of the door so as to form a takeout space. A discharge opening 9*a* through which water or ice is dispensed, and a switch or a lever 8 for dispensing water or ice are provided in the cavity 7. Generally, the switch or lever 8 is operated in a backward-pushed manner upon contacting a cup or another vessel. A remaining water collecting box 9*b* is provided at a lower side of the cavity 7. When the remaining water collecting box 9*b* is filled with water, a user has only to draw out the remaining water collecting box 9*b*. This facilitates a cleaning operation.

A display panel 5 for displaying an operation state of the dispenser is provided on the dispenser, and a plurality of manipulation buttons 6 for manipulating the dispenser according to a use's intention.

However, the conventional refrigerator has the following problems. Firstly, since the cavity 7 is positioned at a central region of one door in a concaved shape, the entire appearance of the refrigerator is degraded. With the preference for a simple and neat appearance, the appearance of the cavity is not optimal.

Secondly, water dropping from the discharge opening splashes in water collected in the remaining water collecting box onto an inner surface of the cavity. Furthermore, water dropping from the discharge opening may contact an inner surface of the cavity. This may cause the propagation of germs and fur (scale), resulting in a degraded appearance. Besides, in order to clean the inner surface of the inward-concaved cavity, a cleaning tool or a user's hand has to be put into a narrow space. This may cause a cleaning operation to be difficult.

Thirdly, the dispenser 4 for a refrigerator has to be provided, on the door, with each type of mechanical device for dispensing water or ice, or each type of electronic device for display. In order to dispense both water and ice, the door has to have a wide thickness. This may reduce storage space inside the body of the refrigerator. As a result, the spatial efficiency may be lowered.

Fourthly, one discharge opening for dispensing water and ice is provided, or a water discharge opening and an ice discharge opening are separately provided in an undistinguished manner. This may cause a user to have difficulty in recognizing the desired opening, resulting in the user's inconvenience.

SUMMARY OF THE INVENTION

Therefore, an object of the invention is to provide a dispenser for a refrigerator, capable of enhancing the appearance by preventing a concave cavity in an outer surface of a door from being visible from the outside, and by configuring water or ice to be dispensed in a state that the cavity is not externally visible.

Another object of the invention is to provide a dispenser for a refrigerator capable of enhancing the appearance and having an enhanced sanitary characteristic, by preventing water dropping from a discharge opening from remaining in a cavity of the dispenser, and thus preventing the propagation of germs and fur (scale).

Still another object of the invention is to provide a dispenser for a refrigerator capable of improving spatial efficiency by increasing storage space inside a refrigerator body by reducing a thickness of a door by an efficient arrangement of the dispenser.

Yet still another object of the invention is to provide a dispenser for a refrigerator capable of enhancing a user's convenience by allowing a user to easily recognize a water discharge opening from an ice discharge opening, and by allowing the user to easily check a display, etc.

To achieve these and other objects and in accordance with the purpose of this specification, as embodied and broadly described herein, there is provided a dispenser for a refrigerator, the dispenser including a cavity provided at one side of a door, a discharge opening provided at an upper side of the cavity a cover movable to inside of the cavity, and configured to open and close the cavity an inclination surface provided on an inner surface of the cavity, and having an upward inclination toward the inside of the cavity and a switch provided on the inclination surface, and configured to control water or ice to be dispensed from the discharge opening, wherein the switch is operated to allow water or ice to be dispensed from the discharge opening when the cover moves inside of the cavity.

The cover may be positioned on the same plane as an outer surface of the door when the cavity is closed, thereby closing the cavity.

The concave cavity may be blocked by the cover, and water or ice may be dispensed as the cover is pressed. This configuration may enhance the appearance.

The dispenser for a refrigerator may further include a remaining water collecting box provided at a lower side of the cavity. The cover may be inclined when moving in the cavity to contact the inclination surface. The discharge opening may be disposed at an upper side of the inclined cover such that water or ice discharged from the discharge opening is collected into the remaining water collecting box along an outer surface of the inclined cover. Water dropping from the discharge opening may flow down along the outer surface of the cover so as not to remain in the cavity of the dispenser. This may prevent the propagation of germs and the occurrence of fur (scale) in the cavity. As a result, the dispenser may have an enhanced appearance and an improved sanitary characteristic.

The dispenser for a refrigerator may further include a guide rail formed on an inner side surface of the cavity, and configured to guide the cover to contact the inclination surface. The guide rail may include a first rail and a second rail, and the first rail may be positioned above the second rail. The first rail may have a longer path than the second rail. Under these configurations, an upper part of the cover may be introduced into the cavity more deeply than a lower part of the cover, and the lower part of the cover may move to an upper side of the remaining water collecting box. In this case, the cover has an inclination. Water may be collected into the remaining water collecting box along an inclined outer surface of the cover. The dispenser for a refrigerator may further include a return spring disposed on a rear surface of the cover.

The concave cavity may be blocked by the cover, and water or ice may be dispensed as the cover is pressed. This configuration may enhance the appearance. Water dropping from the discharge opening may flow down along the outer surface of the cover so as to not remain in the cavity of the dispenser. This may prevent the propagation of germs and the occurrence of fur (scale) in the cavity. As a result, the dispenser may have an enhanced appearance and an improved sanitary characteristic.

A switch may be implemented as a pressing switch, or as an approach sensing switch. The cover may be detachably mounted to the door. This may allow a user to clean the inside of the cavity, or not to block the cavity according to his or her preference. This may enhance the user's convenience. A protective coating sheet may be attached to the outer surface of the cover in an interchangeable manner.

The dispenser for a refrigerator may further include a display unit provided on a side surface of the cavity. The display unit may include a display window and an input unit, and the input unit may be implemented as a plurality of touch sensing buttons.

A user may easily check the display unit, etc., which may enhance the user's convenience. The cavity may include a first cavity for dispensing water, and a second cavity for dispensing ice. The cover may include a first cover for the first cavity, and a second cover for the second cavity. The first cover may be disposed above the second cover. And, the first cover may have a smaller area than the second cover.

A space occupied by the dispenser mounted to the door may be efficiently arranged. This may increase a storage space inside the refrigerator body, thereby enhancing the spatial efficiency. Furthermore, a user may easily recognize a water discharge opening and an ice discharge opening in a distinguished manner, and may easily check the display unit, etc. This may enhance the user's convenience.

The concave cavity may be blocked by the cover, and water or ice may be dispensed as the cover is pressed. This configuration may enhance the appearance.

Water dropping from the discharge opening may flow down along the outer surface of the cover so as not to remain in the cavity of the dispenser. This may prevent the propagation of germs and the occurrence of fur (scale) in the cavity. As a result, the dispenser may have an enhanced appearance and an improved sanitary characteristic.

A user may clean the inside of the cavity, or may not block the cavity according to his or her intention. This may enhance the user's convenience.

Further advantages of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail of the embodiments, with reference to the accompanying drawings. For the sake of brief description with reference to the drawings, the same or equivalent components will be provided with the same reference numbers, and description thereof will not be repeated.

Figure 1:
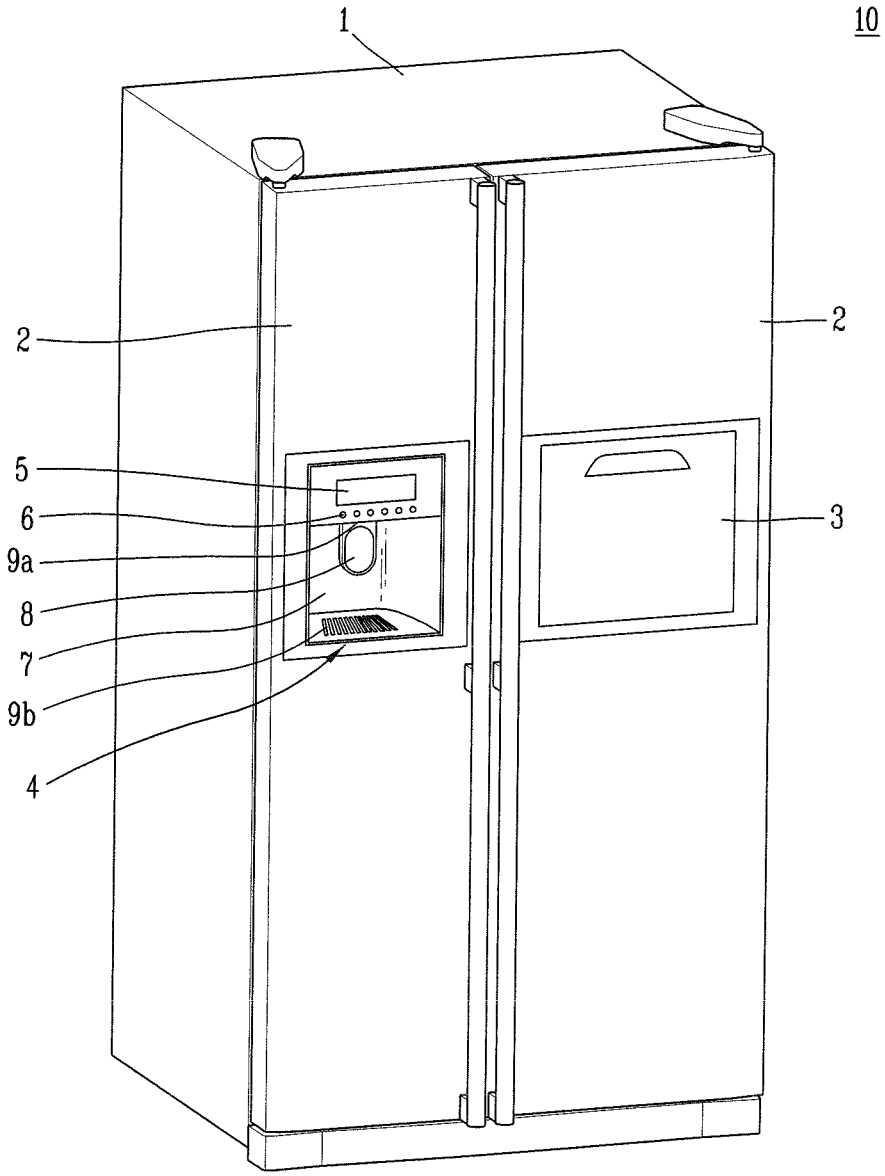
FIG. 1 PRIOR ART
FIG. 1 is a perspective view schematically showing the appearance of a two-door refrigerator in accordance with the conventional art.
Figure 2:
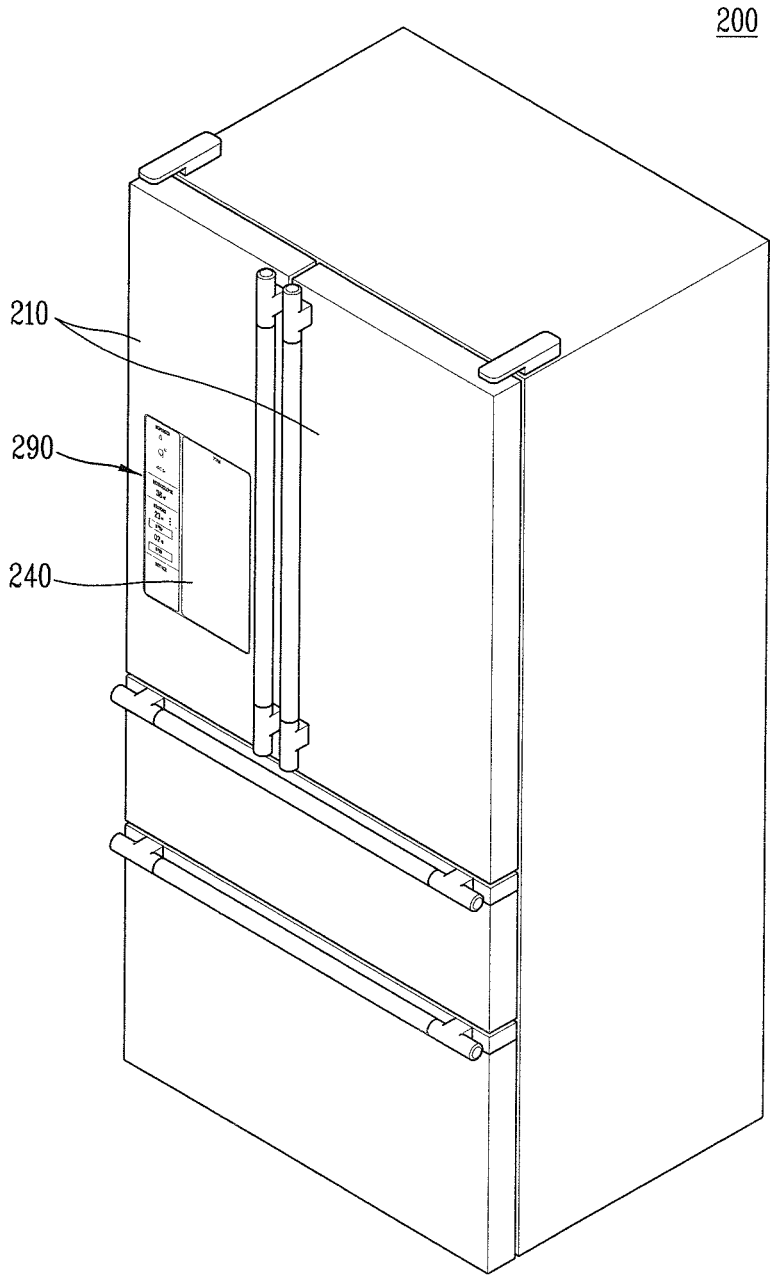
FIG. 2 is a perspective view schematically showing the appearance of a refrigerator according to the present invention.
Figure 3:
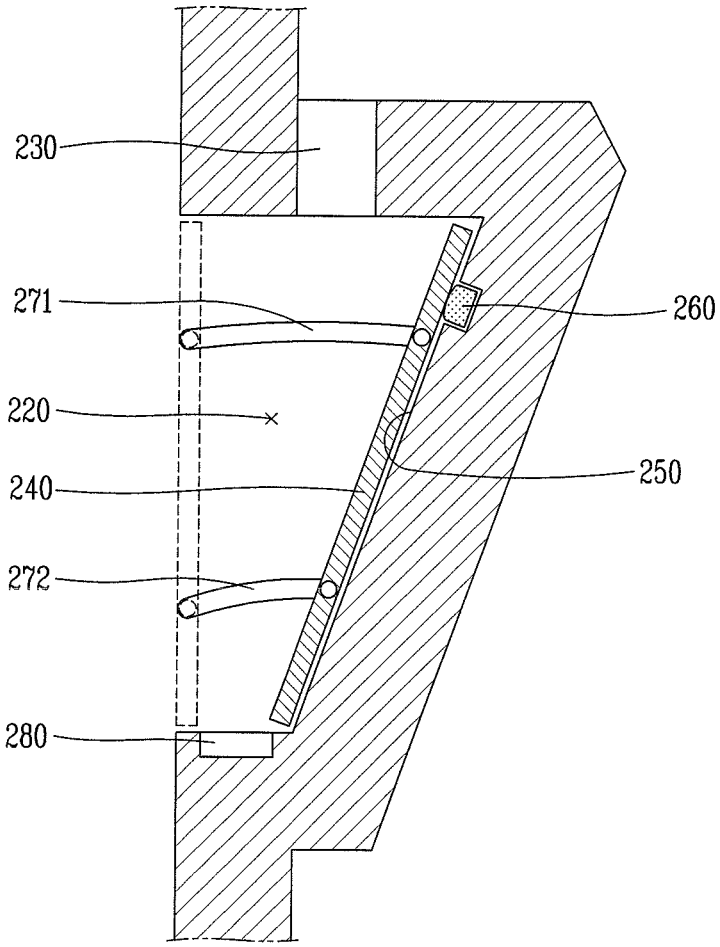
FIG. 3 is a side cross sectional view of a dispenser for a refrigerator according to the present invention.

FIG. 2 is a perspective view showing the appearance of a refrigerator according to the present invention, and FIG. 3 is a side cross sectional view of a dispenser for a refrigerator according to the present disclosure.

The refrigerator body 200 is provided therein with a plurality of drawers and trays for storing food items in a frozen or cooled state. FIG. 2 is an exemplary view of a two-door refrigerator. The door 210 is provided on a front surface of the refrigerator body 200 so as to be outward rotatable so that the left or right side of the refrigerator body 200 can be selectively opened or closed. However, the present disclosure is not limited to the two-door refrigerator.

Referring to FIGS. 2 and 3, the dispenser for a refrigerator according to the present disclosure comprises a cavity 220 provided at one side of a door 210 of a refrigerator body 200, and open and closed by a cover 240.

The cavity 220 is concave, thereby forming a space where a discharge opening, a lever, etc. are mounted. Generally, a door has a planar outer surface. In this case, a discharge opening, a lever, etc. are mounted to the planar outer surface of the door in a protruded state. If a discharge opening, a lever, etc. is mounted to the planar outer surface of the door in a protruded state, the refrigerator may be damaged during transfer. For a user's convenience in operation, it is preferable to provide a cavity at the door so that a discharge opening, a lever, etc. can be mounted therein.

FIG. 3 is a side cross sectional view of a dispenser for a refrigerator according to the present disclosure.

The dispenser for a refrigerator according to the present disclosure comprises a discharge opening 230 disposed at an upper surface of the cavity 220, a cover 240 movable to the inside of the cavity and configured to open and close the cavity, a rear surface 250 formed on an inner surface of the cavity which may have an upward inclination toward the inside of the cavity, and a switch 260 provided on the inclination surface and configured to control water or ice to be dispensed from the discharge opening.

Due to the inclination surface, the cavity has an inward concaved structure. This structure of the inclination surface allows even a tall bottle or a bottle having a long neck portion to be introduced into the cavity in an inclined state.

The discharge opening 230 is provided at an upper side of the inclination surface 250, i.e., at an upper side of the cavity 220. The discharge opening 230 is formed so as to be exposed to the outside of the door when the cover is moved into the cavity. From the discharge opening 230, a user may dispense water or ice.

A switch provided inside the cavity is contacted by the cover when the cover moves into the cavity in order to allow dispensing of water or ice. The switch may be placed in any suitable location within the cavity to be contacted by the cover, such as on a rear or side surface of the cavity. FIG. 3 depicts a switch 260 provided on the inclination surface, and operated by proximity or contact with the cover to be later explained. The switch 260 may operate to open a water discharge opening so that water can be dispensed through the water discharge opening, or may operate to open a valve of a water supply line disposed inside the door. Alternatively, the switch 260 may operate to open an ice discharge opening so that ice can be dispensed through the ice discharge opening, or may operate an ice supply line disposed inside the door.

The switch 260 may be implemented as a pressing switch. In this case, the switch is operated in a pressing manner when the cover comes in contact with the inclination surface. Alternatively, the switch 260 may be implemented as a proximity sensing switch. In this case, the switch is operated upon detecting approach of the cover. FIG. 3 shows a state that the switch has been pressed by the cover.

The cover 240 is provided on a front surface of the cavity so that the cavity can be closed. The cover is positioned on the same plane as the outer surface of the door when the cavity is closed, thereby blocking the cavity. This may enhance the appearance.

As shown in FIG. 3, the switch 260 is operated to allow water or ice to be dispensed from the discharge opening 230 when the cover 240 moves inside the cavity to contact the inclination surface 250. A guide rail configured to guide the cover to contact the inclination surface is provided on an inner side surface of the cavity. The guide rail includes a first rail 271 and a second rail 272, with the first rail 271 positioned above the second rail 272. The first rail 271 has a longer path than the second rail 272. Under these configurations, when the cover 240 moves into the cavity along the guide rails 271 and 272, an upper part of the cover 240 is introduced into the cavity more deeply than a lower part of the cover 240. That is, the cover is inclined so as to contact the inclination surface disposed inside the cavity when the cavity is open.

The dispenser for a refrigerator may further include a remaining water collecting box 280 provided at a lower side of the cavity. Referring to FIG. 3, the remaining water collecting box 280 is positioned at a lower end of the inclination surface. A discharge opening through which collected water is discharged may be provided in the remaining water collecting box 280.

The cover 240 is inclined upon contacting the inclination surface while moving in the cavity along the guide rails. More concretely, due to a path difference between the first and second rails, the upper part of the cover is deeply introduced into the cavity along the inclination surface, and the lower part of the cover moves to an upper side of the remaining water collecting box. Water or ice discharged from the discharge opening 230 can be collected into the remaining water collecting box 280 along an outer surface of the inclined cover. Under this configuration, water dropping from the discharge opening does not remain in the cavity of the dispenser, but flows down along the outer surface of the cover. This may prevent the propagation of germs and fur (scale) in the cavity. As a result, the dispenser may have an enhanced appearance and an improved sanitary characteristic.

As shown in FIG. 3, the cover 240 may be configured to be introduced into the cavity so as to contact the inclination surface, and to be restored to the original position so that the cavity can be closed. For this, the cover may be provided with a return spring on a rear surface thereof. The return spring may be provided to contact the rear surface of the cover and the inclination surface, respectively. Alternatively, the return spring may be provided on each of the first and second rails as shown in FIG. 3. Descriptions about a method for mounting the return spring have been already well-known, and thus detailed explanations thereof will be omitted.

The cover 240 may be detachably mounted to the door. A user may remove the cover from the cavity by detaching the cover from the guide rail. In this case, the user may clean the inside of the cavity, and may not block the cavity according to his or her intention. This may enhance the user's convenience.

Figure 4:
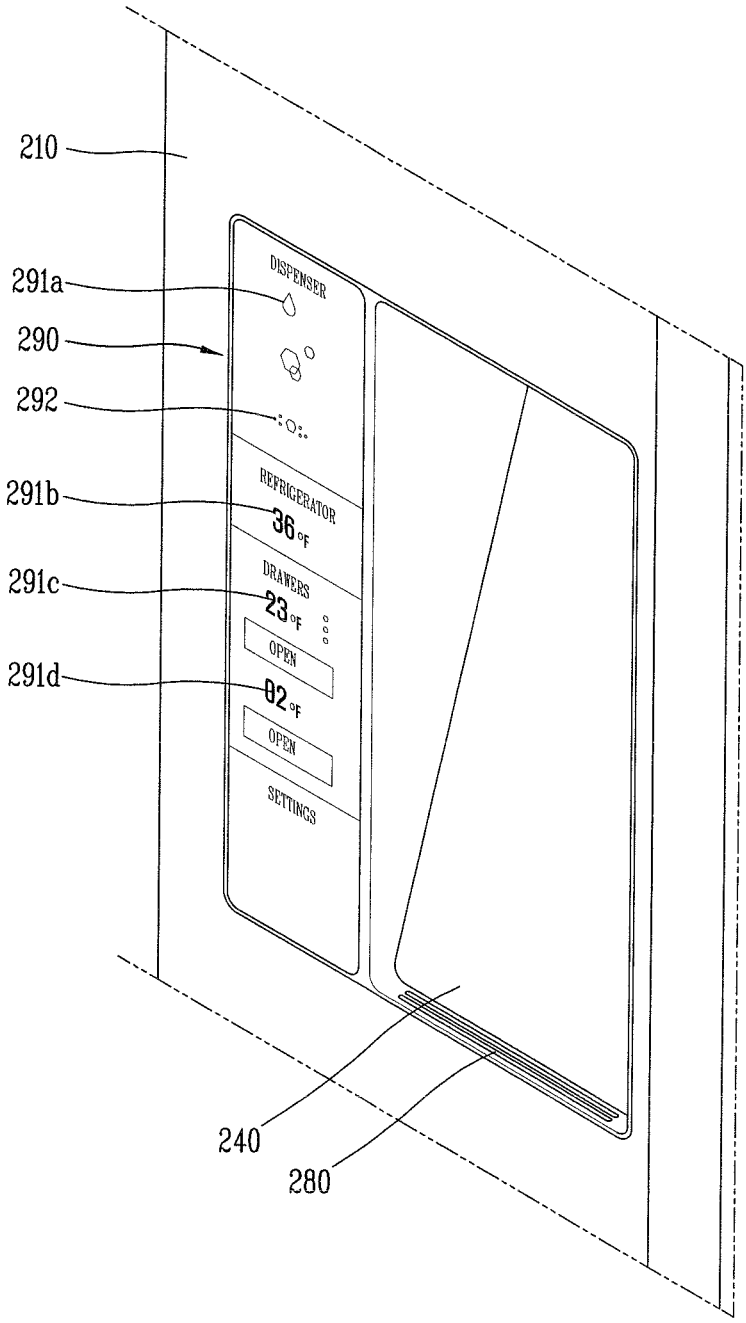
FIG. 4 is a perspective view of a dispenser for a refrigerator according to the present invention.
Figure 5:
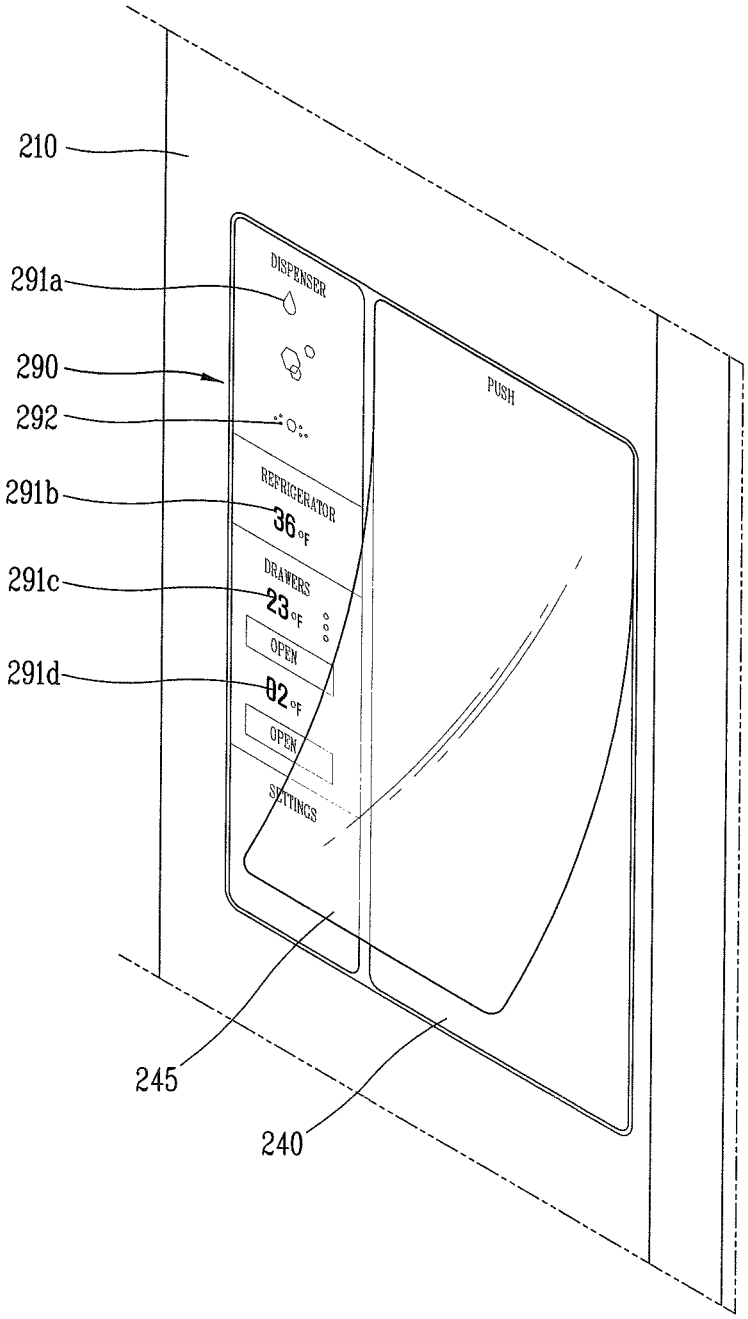
FIG. 5 is a perspective view showing a protective coating sheet applied to a cover.

The dispenser for a refrigerator may further include a display unit 290 provided next to the cavity. The display unit 290 may include a display window 291 and an input unit 292. The display window 291 displays, on the door, an operation state of the refrigerator including the dispenser, so that a user can check a usage state of the refrigerator. FIGS. 4 and 5 illustrate an operation state of each window displayed on the display window 291.

Referring to FIGS. 4 and 5, a first window 291*a* displays a state of the dispenser. The ice discharge opening provides not only ice cubes, but also crushed ice. The window 291*a* displays the states of water, ice cubes and crushed ice so that a user can be prevented from erroneously operating the dispenser. A second window 291*b* displays a state of a refrigerating chamber. The window 291*b* displays an inner temperature of a refrigerating chamber so that a user can determine whether the inner temperature of the refrigerating chamber is a proper temperature. A third window 291*c* displays a state of a drawer-type converting chamber of the refrigerator. The converting chamber is configured to serve as a meat storage space or a vegetable storage space. More concretely, since a meat storage temperature and a vegetable storage temperature are different from each other, the converting chamber may be selectively implemented as a meat storage space or a vegetable storage space according to a usage purpose. Furthermore, the window 291*c* displays an open state of the drawer-type converting chamber. A fourth window 291*d* displays a state of a freezing chamber. These windows may be arranged according to the positional order of the storage spaces for facilitation of a user's recognition.

The input unit 292 includes a plurality of input means for manipulating the dispenser according to a user's intention. Referring to FIGS. 4 and 5, the dispenser is provided with one discharge opening. Through one discharge opening, at least three types of objects (water, ice cubes and crushed ice) may be dispensed. Accordingly, an object to be dispensed from the discharge opening has to be determined. In FIGS. 4 and 5, the input unit is implemented as a plurality of touch sensing buttons. The touch sensing buttons may be implemented as a touch pad (capacitance/static electricity) with a layered structure on the display window. A user may perform an input by touching the display window 291. That is, the display window and the input unit may be positioned in an overlapping manner. Here, the input unit 292 may be configured to include general buttons.

The display unit 290 may be installed at the door so as to be upward inclined toward the inside of the door. This configuration is implemented, with consideration of a diffused (irregular) reflection of light, a user's eye direction, etc., so as to allow a user to easily check a state of the refrigerator. This may enhance a user's convenience.

As shown in FIG. 5, a protective coating sheet 245 may be attached to an outer surface of the cover in an interchangeable manner. If the cover has a scratch thereon, a user has only to replace the protective coating sheet 245 with a new one. This may allow the cover to maintain a good appearance.

Figure 6:
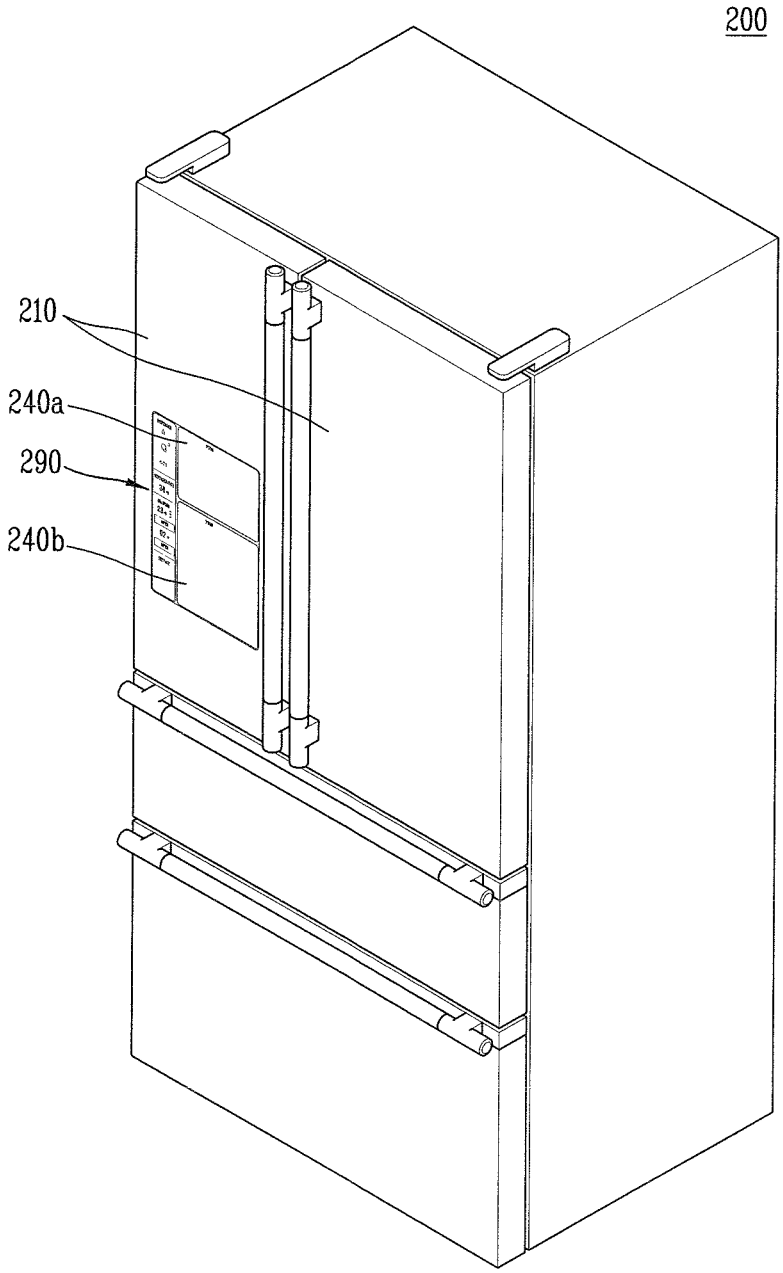
FIG. 6 is a perspective view showing a refrigerator having two cavities.
Figure 7:
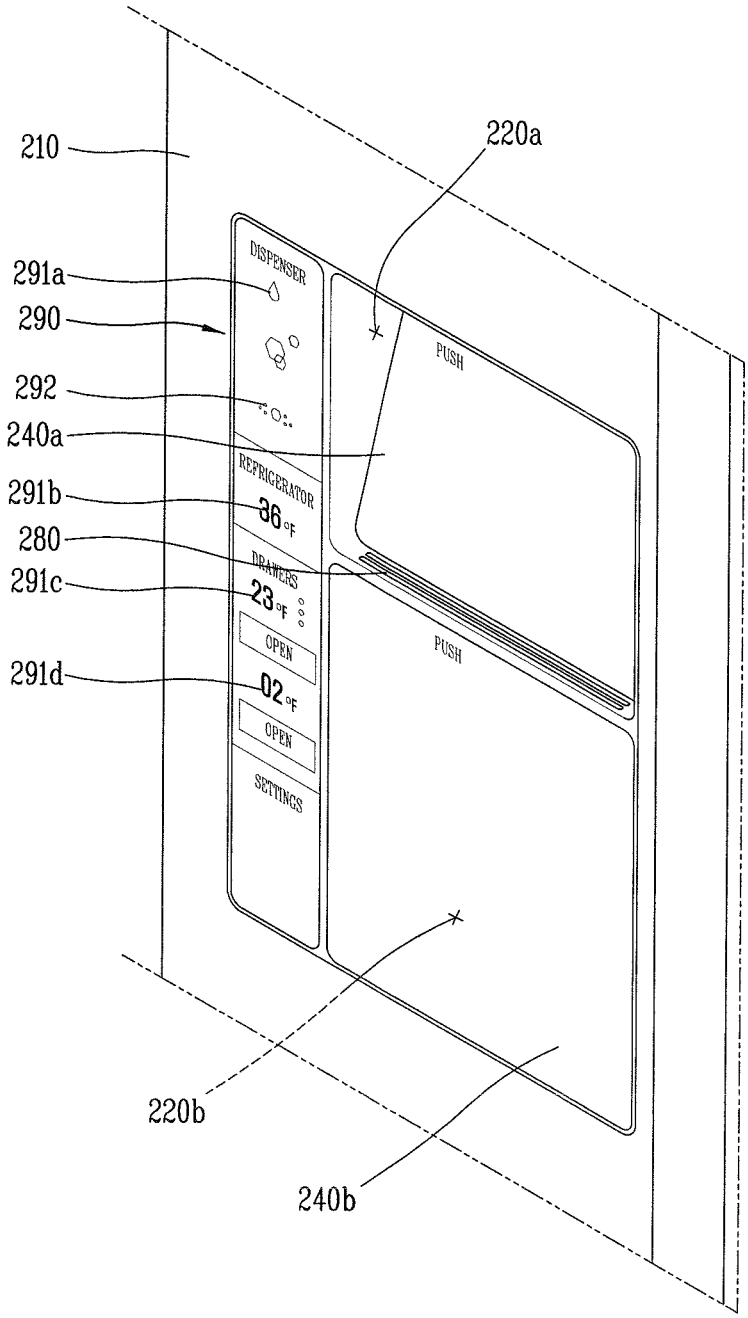
FIG. 7 is a perspective view of a dispenser for the refrigerator of FIG. 6.

Referring to FIGS. 6 and 7, the cavity of the dispenser for a refrigerator according to the present invention includes a first cavity 220*a* for dispensing water, and a second cavity 220*b* for dispensing ice. The cover includes a first cover 240*a* for the first cavity, and a second cover 240*b* for the second cavity. The first cover is visually different than the second cover, such as being smaller, to allow the user to easily distinguish between the two cavities. Referring to FIG. 7, the first cover is disposed above the second cover. And, the first cover has a smaller area than the second cover.

The first cavity 220*a* is provided with a water discharge opening through which water is dispensed. The water discharge opening is exposed to the outside of the door. As the first cover 240*a* presses a switch disposed on an inclination surface provided in the first cavity 220*a*, the water discharge opening is open so that water can be dispensed therethrough, or a valve of a water supply line inside the door is open.

The second cavity 220*b* is provided below the first cavity 220*a*. That is, the first cavity 220*a* for dispensing water, and the second cavity 220*b* for dispensing ice are separately provided at the door. This is in order to enhance a user's convenience, by allowing a user to easily recognize the water discharge opening and the ice discharge opening. The second cavity 220*b* is provided with an ice discharge opening (not shown) from which ice is dispensed. The ice discharge opening is exposed to the outside of the door. Through the ice discharge opening, a user may dispense ice generated in the refrigerator and stored inside the door. As the second cover 240*b* presses a switch disposed on an inclination surface provided in the second cover 240*b*, the ice discharge opening is open so that ice can be dispensed therethrough, and an ice supply device inside the door is operated.

Referring to FIG. 7, an area of the second cover 240*b* is larger than that of the first cover 240*a*. However, this is merely exemplary. That is, the first cover 240*a* may be distinguished from the second cover 240*b* by having an area different from that of the second cover 240*b*. This may allow a user to easily recognize the first cavity for dispensing water and the second cavity for dispensing ice.

Under the configuration where the first cavity dispensing water and the second cavity for dispensing ice are separately provided in a vertical direction, a space occupied by the dispenser mounted to the door may be efficiently arranged. This may increase a storage space inside the refrigerator body, thereby enhancing the spatial efficiency. More concretely, if an ice dispensing operation and a water dispensing operation are performed in the same cavity, mechanical devices for dispensing water and ice have to be provided inside the door. If the mechanical devices are to be positioned at the same height, the mechanical devices have to be provided in the same cavity. This may cause the door to have a large thickness, resulting in a decrease of storage space inside the refrigerator body. On the other hand, the first cavity for dispensing water and the second cavity for dispensing ice are separately provided in a vertical direction. This may allow the door to have a reduced thickness in a state that the mechanical devices vertically spaced from one another. As a result, storage space inside the refrigerator body may be increased to enhance the spatial efficiency.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A dispenser for a refrigerator, the dispenser comprising:

a cavity provided on a door and having an upper surface, a rear surface, a lower surface and a side surface;

an ice or water discharge opening provided at an upper portion of the cavity;

a cover movably mounted to the cavity;

an inclined surface provided on the rear surface of the cavity;

a switch provided on the inclined surface and operated to allow water or ice to be dispensed from the ice or water discharge opening when the cover moves to inside of the cavity;

guide members disposed on the side surface of the cavity to move the cover within the cavity; and a remaining water collecting box provided at the lower surface of the cavity, wherein the remaining water collecting box is exposed and remaining water is collected into the remaining water collecting box along an outer surface of the cover when the cover moves inside of the cavity.

2. The dispenser for a refrigerator of claim 1, wherein the cover is coplanar with an outer surface of the door when the cavity is closed.

3. The dispenser for a refrigerator of claim 1, wherein the guide members comprise a first rail and a second rail, wherein the first rail is positioned above the second rail, and the first rail has a longer path than the second rail, and wherein the cover is inclined when an upper part thereof is introduced into the cavity more deeply than a lower part thereof, and the lower part of the cover moves to an upper side of the remaining water collecting box, such that water is collected into the remaining water collecting box along an inclined outer surface of the cover.

4. The dispenser for a refrigerator of claim 1, further comprising a return spring disposed on a rear surface of the cover.

5. The dispenser for a refrigerator of claim 1, wherein the switch is implemented as a pressing switch.

6. The dispenser for a refrigerator of claim 1, wherein the cover is detachably mounted to the door.

7. The dispenser for a refrigerator of claim 1, wherein the switch is implemented as a proximity sensing switch.

8. The dispenser for a refrigerator of claim 1, wherein a protective coating sheet is attached to the outer surface of the cover in an interchangeable manner.

9. The dispenser for a refrigerator of claim 1, further comprising a display unit provided next to the cavity.

10. The dispenser for a refrigerator of claim 9, wherein the display unit comprises a display window and an input unit, and wherein the input unit is implemented as touch sensing buttons.

11. The dispenser for a refrigerator of claim 1, wherein the cavity comprises a first cavity for dispensing water, and a second cavity for dispensing ice, wherein the cover comprises a first cover for the first cavity, and a second cover for the second cavity, and wherein the first cover is disposed above the second cover, and the first cover is distinguished from the second cover by having a different size than the second cover.

12. The dispenser for a refrigerator of claim 1, wherein a bottom edge of the cover moves laterally into the cavity when the cover moves to inside the cavity.

13. A dispenser for a refrigerator, the dispenser comprising:

a cavity provided at one side of a door, the cavity having an upper surface, a rear surface, a lower surface and a side surface;

a discharge opening provided at the upper side of the cavity;

a cover movable to inside of the cavity, and configured to open and close the cavity;

an inclination surface provided on the rear surface of the cavity;

a switch provided on the inclination surface, and configured to control water or ice to be dispensed from the discharge opening;

a guide rail formed on the side surface of the cavity to guide the cover inside of the cavity including a first rail and a second rail; and a remaining water collecting box provided at the lower surface of the cavity, wherein the switch is operated to allow water or ice to be dispensed from the discharge opening when the cover moves to the inside of the cavity, wherein the discharge opening is disposed at an upper side of the cover, such that water discharged from the discharge opening is collected into the remaining water collecting box along an outer surface of the cover, wherein the first rail is positioned above the second rail, and the first rail has a longer path than the second rail, and wherein the cover is inclined when an upper part thereof is introduced into the cavity more deeply than a lower part thereof, and the lower part of the cover moves to an upper side of the remaining water collecting box, such that water is collected into the remaining water collecting box along an inclined outer surface of the cover.

* * * * *